US007004229B2

(12) United States Patent
Salee et al.

(10) Patent No.: US 7,004,229 B2
(45) Date of Patent: Feb. 28, 2006

(54) METHOD AND APPARATUS FOR STARTING AND STOPPING A HORIZONTAL CASTING MACHINE

(75) Inventors: David A. Salee, Spokane, WA (US); Jack Hamby, Chattaroy, WA (US); Wade Lee Bowles, Spokane, WA (US); John Steven Tingey, Rathdrum, ID (US)

(73) Assignee: Novelis, Inc., Toronto (CA)

( * ) Notice: Subject to any disclaimer, the term of this patent is extended or adjusted under 35 U.S.C. 154(b) by 76 days.

(21) Appl. No.: 10/735,074

(22) Filed: Dec. 11, 2003

(65) Prior Publication Data

US 2005/0126744 A1 Jun. 16, 2005

(51) Int. Cl.
*B22D 11/08* (2006.01)

(52) U.S. Cl. ..... 164/483; 164/420; 164/425; 164/440; 164/441; 164/490; 164/337; 164/136

(58) Field of Classification Search ..... 164/483, 164/420, 425, 440, 441, 490, 337, 136
See application file for complete search history.

(56) References Cited

U.S. PATENT DOCUMENTS

| | | | | |
|---|---|---|---|---|
| 2,880,989 | A * | 4/1959 | Stauffer | 266/196 |
| 3,344,845 | A * | 10/1967 | Blessinger et al. | 164/420 |
| 3,455,369 | A | 7/1969 | Craig | 164/73 |
| 3,623,534 | A | 11/1971 | Brennan | 164/82 |
| 3,630,266 | A | 12/1971 | Watts | 164/73 |
| 3,653,427 | A * | 4/1972 | Evans | 164/425 |
| 3,850,225 | A | 11/1974 | McNitt et al. | 164/82 |
| 3,908,746 | A * | 9/1975 | Follrath et al. | 164/152 |
| 4,178,000 | A * | 12/1979 | Kuttner | 277/468 |
| 4,252,179 | A | 2/1981 | Scholtze et al. | 164/446 |
| 4,381,030 | A | 4/1983 | Knell | 164/446 |
| 4,434,839 | A | 3/1984 | Vogel | 164/485 |
| 4,454,907 | A | 6/1984 | Flowers | 164/425 |
| 4,688,624 | A * | 8/1987 | Suzuki et al. | 164/440 |
| 4,982,779 | A | 1/1991 | Nagai et al. | 164/152 |
| 5,228,496 | A | 7/1993 | Nagai et al. | 164/472 |
| 6,446,704 | B1 | 9/2002 | Collins | 164/488 |

FOREIGN PATENT DOCUMENTS

| | | |
|---|---|---|
| CA | 1157226 | 11/1983 |
| CA | 2350861 | 12/2002 |
| WO | WO 01/49433 | 7/2001 |

* cited by examiner

*Primary Examiner*—Kevin Kerns
*Assistant Examiner*—I.-H. Lin
(74) *Attorney, Agent, or Firm*—Cooper & Dunham LLP

(57) ABSTRACT

An apparatus is described for starting and stopping a horizontal casting machine, e.g. a caster for continuous casting of metal ingots. The caster comprises a feed trough for carrying molten metal, at least one casting mould and a connecting trough separately connecting each casting mould to the feed trough. A shutoff gate is associated with each connecting trough and movable between an open position and a closed position. Each connecting trough includes a drop-down portion located between the shutoff gate and the casting mould, this drop-down portion being adapted to swing downwardly and thereby rapidly drain molten metal from the connecting trough and an entrance of the mould. The apparatus may also include an elongated starter block, adapted to be inserted into the casting mould and having a threaded recess formed therein for receiving molten metal. An O-ring is fitted to the starter block to seal the block against the casting mould.

15 Claims, 7 Drawing Sheets

METHOD AND APPARATUS FOR STARTING AND STOPPING A HORIZONTAL CASTING MACHINE

FIELD OF THE INVENTION

The invention generally relates to apparatus and methods for stopping operation of horizontal casting machines and apparatus for starting or restarting such machines after they have been stopped.

BACKGROUND OF THE INVENTION

Horizontal continuous casting is commonly used in the production of metal ingots from molten metal. Continuous casters can produce ingots of various cross-sectional shape and girth, by varying the casting mould used in the caster. Ingots can then be cut to desired lengths downstream of the caster. An example of a conventional horizontal continuous caster can be seen in, for example, U.S. Pat. No. 3,455,369.

Multi-strand horizontal casters are a particular type of caster, which allow multiple strands of ingots to be cast at the same time. Such casters generally have a molten metal feed trough connected to multiple casting moulds either via a single header box or via dedicated separate connecting troughs for each mould.

It is often required to temporarily isolate and shut down one or more strands in a multi-strand caster. Possible reasons for shutdown include upsets in either upstream or downstream operations, undesirable conditions of the molten metal, or general maintenance and repair of the caster. Improper isolation of the particular connecting trough during shut down can lead to loss of costly molten metal. There is also the possibility of fires or explosions if molten metal is not collected properly or comes into contact with water that is often used in cooling the ingots.

Attempts have been made to isolate and drain particular strands and collect molten metal during shutdown. An example of such a shut-off device can be seen in U.S. Pat. No. 4,928,779. However, such devices often require that the molten metal travel through the connecting trough and the casting mould and drain through the casting mould exit. This can cause molten metal to solidify in the casting mould and reduces access to this part, in case of repairs. As well, many shutdown systems only isolate the trough after molten metal has been sensed at the casting mould exit, so large quantities of molten metal are lost before the trough is isolated.

After the caster has been shut-down, and indeed at a time that the caster is to be started or restarted, it must operate in a manner that is both safe and minimizes any start-up losses of molten or cast metal. A common concern in startup is proper alignment of the cast ingot as it travels towards the cutting equipment. As well, metal leaving the casting mould is generally direct chilled by coolant sprays that impinge on the emerging ingot. In start up, it is important to prevent contact between the coolant and the molten metal, which can lead to explosions and fires.

Several start-up blocks have been devised for use with horizontal continuous casters. Some examples of these are shown in U.S. Pat. Nos. 4,454,907, 4,252,179, 3,850,225 and 4,381,030. However, most of these devices do not positively seal against the mould to prevent contact between molten metal and the coolant. Furthermore, many starter blocks permanently engage the emerging end of the ingot, so that the end of the ingot and the block must be cut from the ingot. This leads to undesirable waste of metal and the starter block.

It is therefore desirable to find shutdown methods and devices that will provide quick isolation of particular strands and rapid draining and collection of molten metal from all parts of the molten metal strand. It is also desirable to develop suitable starter bocks which can ensure proper alignment of the emerging ingot, and reduce chances of fire or explosion.

The invention makes it possible to use a remotely actuated shutoff device to terminate flow through one or more connecting troughs. After termination of flow, the invention also allows easy access to the connecting troughs and the mould.

SUMMARY OF THE INVENTION

The present invention thus provides in one embodiment, an apparatus for continuous casting of metal ingots, comprising a feed trough for carrying molten metal, at least one casting mould for casting metal ingots and a connecting trough separately connecting each casting mould to the feed trough for transferring molten metal. A shutoff gate is associated with each connecting trough and located adjacent the feed trough, this gate being movable between an open position and a closed position. Each connecting trough also includes a drop-down portion located between the shutoff gate and the casing mould, this drop-down portion being adapted to swing downwardly and thereby rapidly drain molten metal from the connecting trough and an entrance of the mould.

The present invention, in a further embodiment, provides an apparatus for continuous casting of metal ingots, comprising a feed trough for carrying molten metal, a casting mould for receiving molten metal, and casting the metal into metal ingots. A source of coolant is positioned to impinge upon a surface of an ingot emerging from the mould to cool the ingot and a conveying device is aligned in the direction of casting of the ingot, for conveying the cast ingot from the casting mould. The apparatus also includes an elongated starter block, adapted to be inserted into the mould and supported by the conveying device and having a threaded recess formed therein for receiving molten metal and an O-ring fitted to the starter block for sealing the block against the casting mould.

In yet another embodiment, the present invention provides a method of stopping casting of at least one strand in a multi-strand continuous molten metal caster for casting ingots. The caster has a feed trough for carrying molten metal, at least one casting mould for casting metal ingots, a connecting trough separately connecting each casting mould to the feed trough for transferring molten metal, a shutoff gate associated with each connecting trough and located adjacent the feed trough, the gate being movable between an open position and a closed position and each connecting trough including a drop-down portion located between the shutoff gate and the casing mould, the drop-down portion being adapted to swing downwardly. The method comprises closing a shutoff gate to isolate at least one connecting trough from the feed trough and swinging the drop-down portion downwardly to rapidly drain molten metal from the connecting trough and an entrance of the mould.

BRIEF DESCRIPTION OF THE DRAWINGS

The present invention will be described in conjunction with the following figures.

DETAILED DESCRIPTION OF PREFERRED EMBODIMENTS OF THE INVENTION

Figure 1:
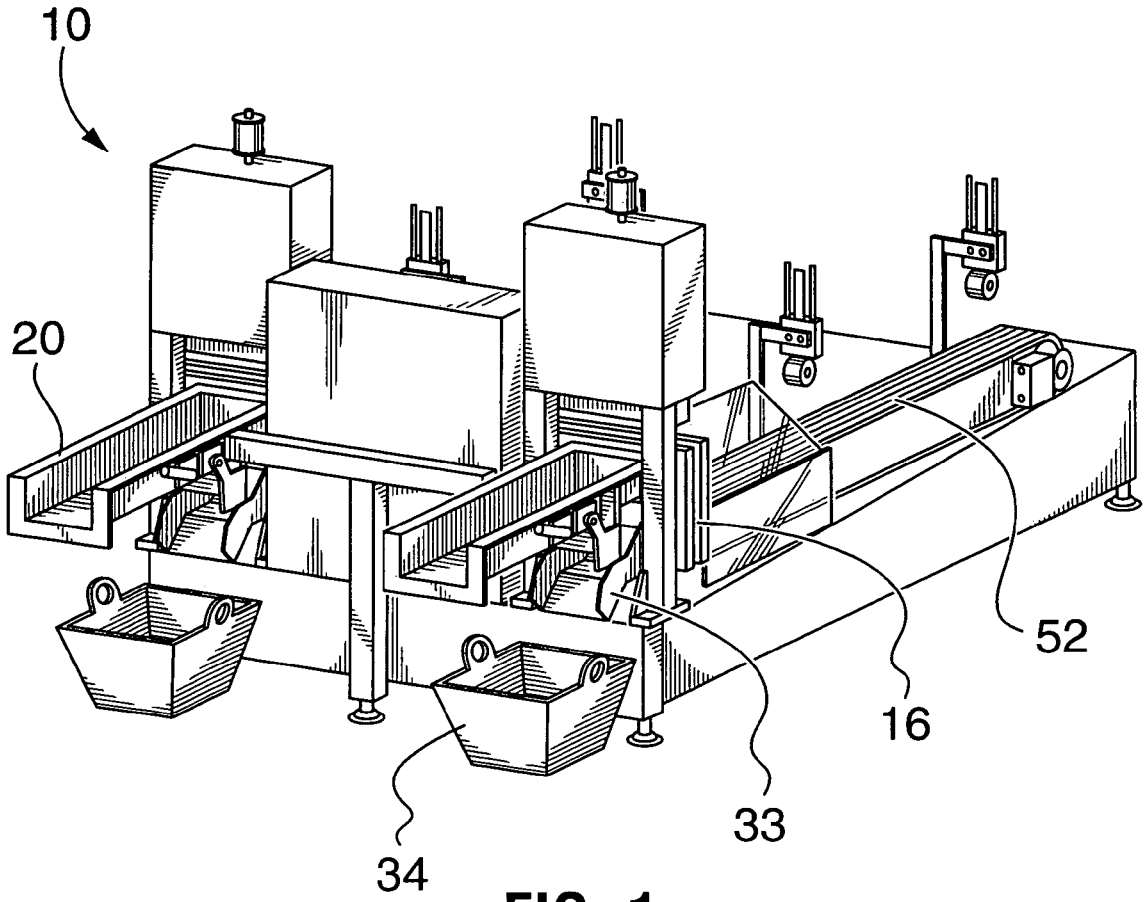
FIG. 1 is a perspective view of a two strand continuous horizontal caster for which the present invention may be used, and downstream ingot-cutting equipment.

FIG. 1 shows a multi-strand horizontal casting machine 10, and in particular a two-strand caster, with its associated downstream equipment. A three-strand casting machine is shown in more detail in FIG. 2. Molten metal 12 travels from a common feed trough 14 to casting moulds 16 which form and produce cast ingots 18 of the desired cross section shape and size. The casting moulds 16 are generally made of metal (e.g. aluminum) body with a refractory entry tube, and may include graphite liners. Each mould 16 most commonly comprises a cooling jacket within the mould body connected to a first coolant source for cooling the molten metal passing through it to form a skin on the ingot.

Cast ingots are then carried away by conveying devices 52 for downstream processing.

Dedicated connecting troughs 20 connect each casting mould 16 to feed trough 14 to form each strand of the multi-strand casting machine 10. A shutoff gate 22 is positioned in each connecting trough 20 adjacent the feed trough 14. The shutoff gate 22 is open for normal operation and can be closed to isolate individual strands from the molten metal 12, in the case of a shut down. Each connecting trough is provided with a drop-down portion 24 adjacent the casting mould 16. This drop-down portion 24 remains in an upright position for normal operation of the caster 10.

Figure 3:
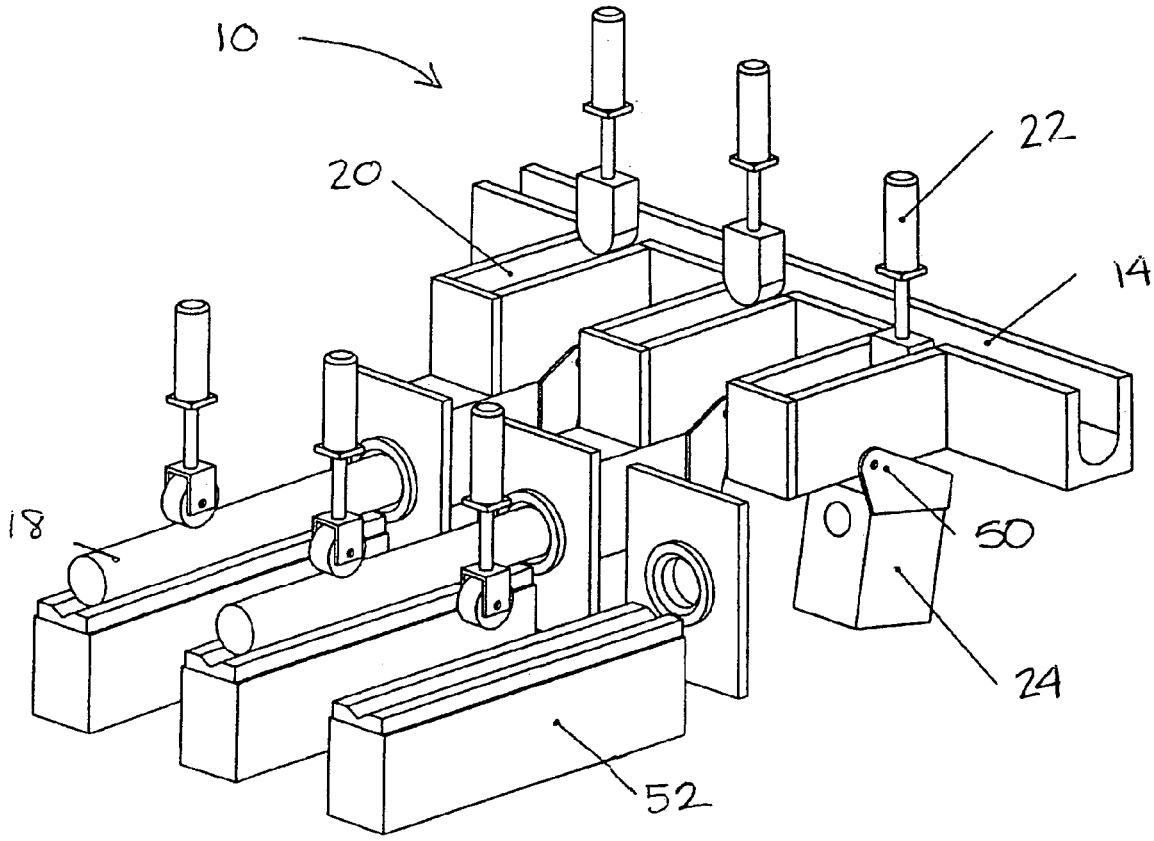
FIG. 3 is a perspective view of the two-strand horizontal caster, showing the shutoff gate and drop-down portion of the present invention in its downward, draining position.
Figure 4B:
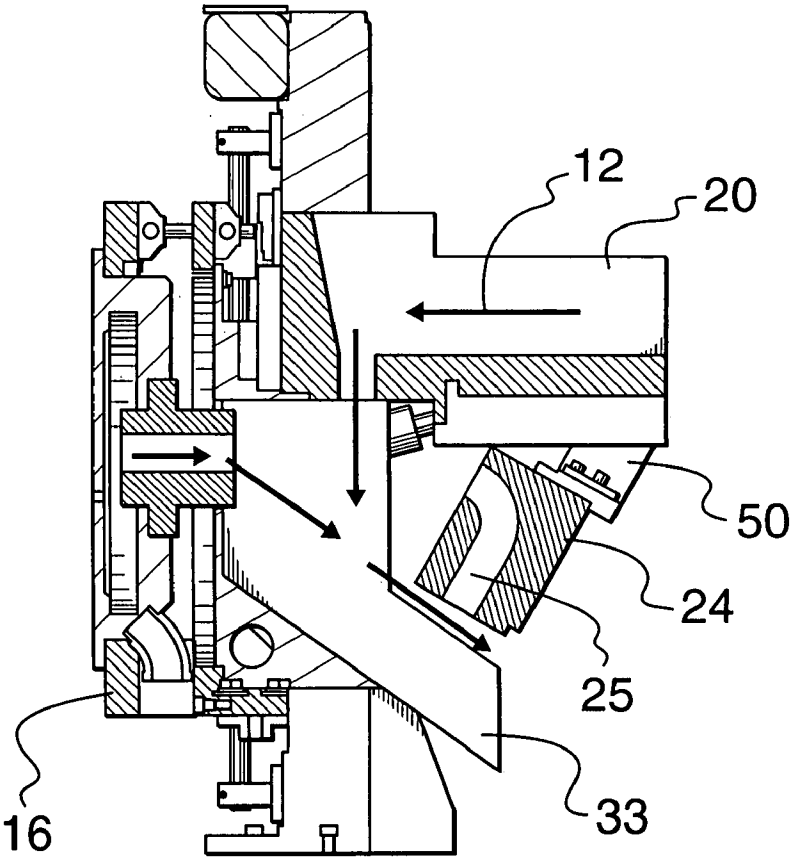
FIG. 4*b* is a cross-sectional view of the horizontal continuous caster, showing the drop-down portion in its downward, draining position.
Figure 4A:
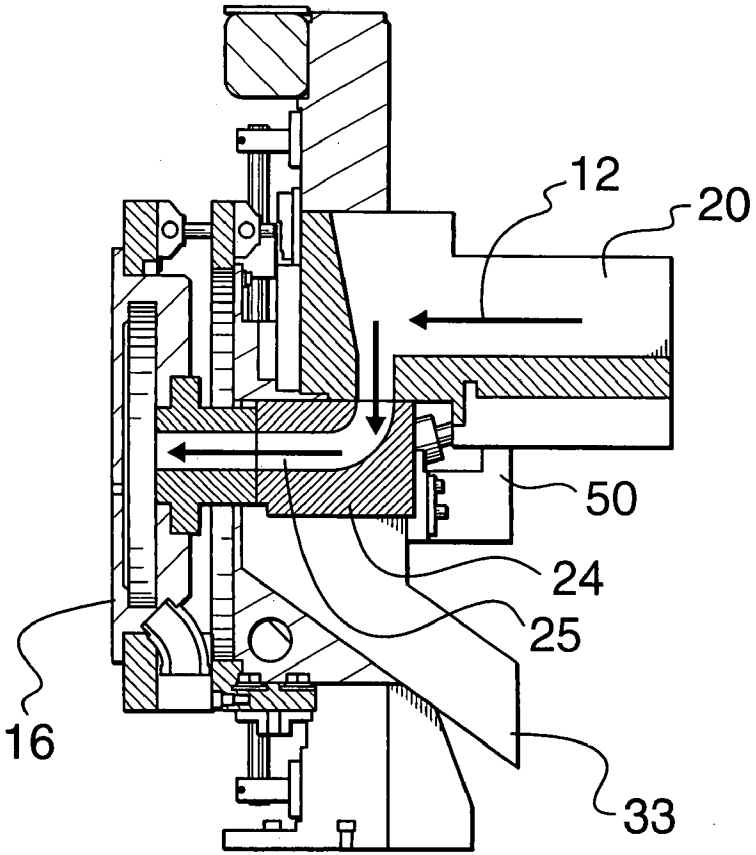
FIG. 4*a* is a cross-sectional view of the horizontal continuous caster, showing the drop-down portion in its upright, operational position.

As seen in FIG. 3, the drop-down portion 24 can be lowered to a downwards position during shutdown to rapidly drain molten metal from the isolated connecting trough 20 and the casting mould 16. FIG. 3 also illustrates one shutoff gate 22 in its closed position to isolate the particular strand from the feed trough 14. FIGS. 4*a* and 4*b* are cross-sectional views showing respectively the operational and shutdown positions of the drop-down portion 24. Each drop-down portion 24 is preferably in the form of a block of refractory material with a passageway 25 therein to carry the molten metal. This passageway 25 has an inlet in the top face of the block and an outlet in an end face thereof, which align respectively with an outlet opening in the connecting trough 20 and an inlet opening to a mould 16. To assure a proper seal between the block 24 and the trough 14 and the mould 16, a Fiberfrax™ paper is applied to the contacting faces.

The feed trough 14 and the connecting troughs 20 are preferably heated troughs. This helps to keep the metal in molten form as it travels to the casting mould.

Figure 2:
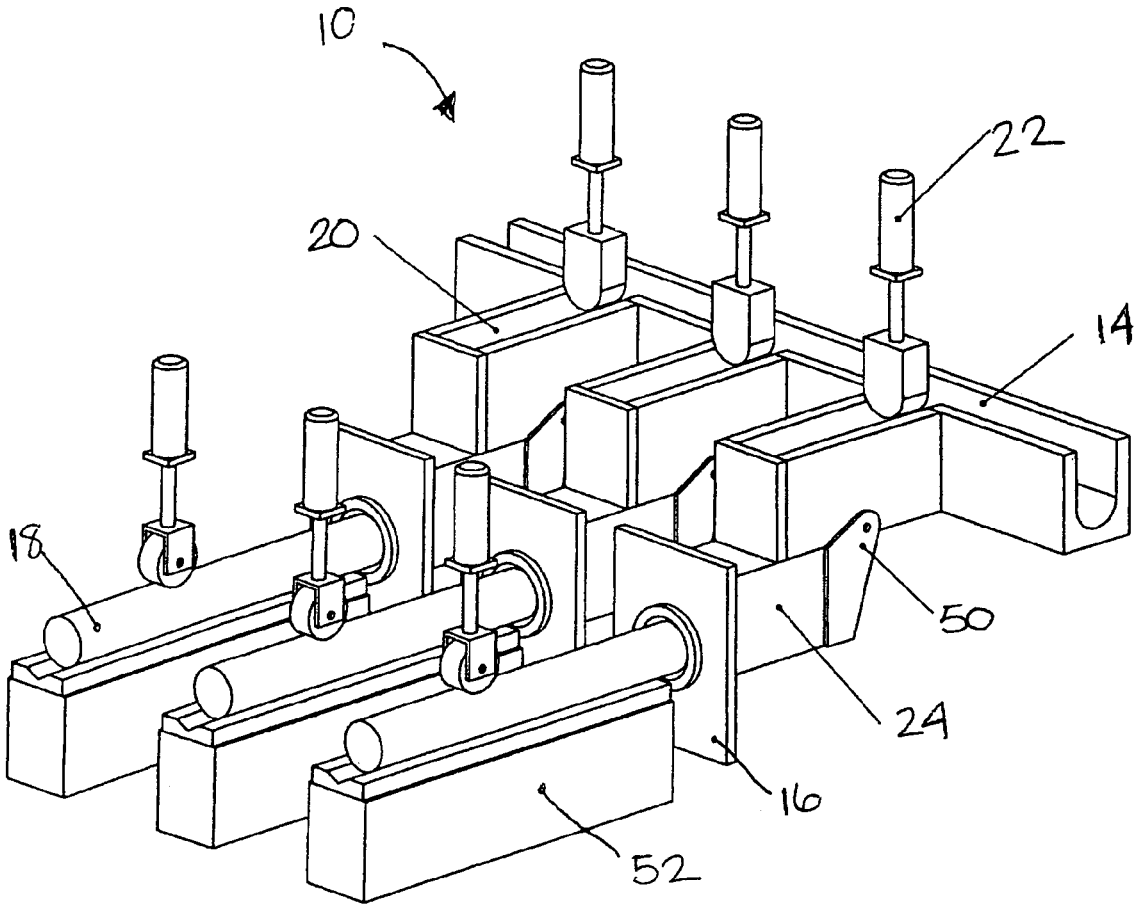
FIG. 2 is a perspective view of the two-strand horizontal caster, showing the shutoff gate and drop-down portion of the present invention, in its upright, operational position.

Although a feed trough 14 has been illustrated in FIGS. 2 and 3 as being connected to the casting moulds 16 via dedicated connecting troughs 20, it is to be understood that the feed trough 14 can also be connected via a single header box (not shown) for supplying molten metal to each casting mould 16. In this case, the shutoff gate 22 lies adjacent the header box to isolate it from the feed trough during shutdown.

Figure 5:
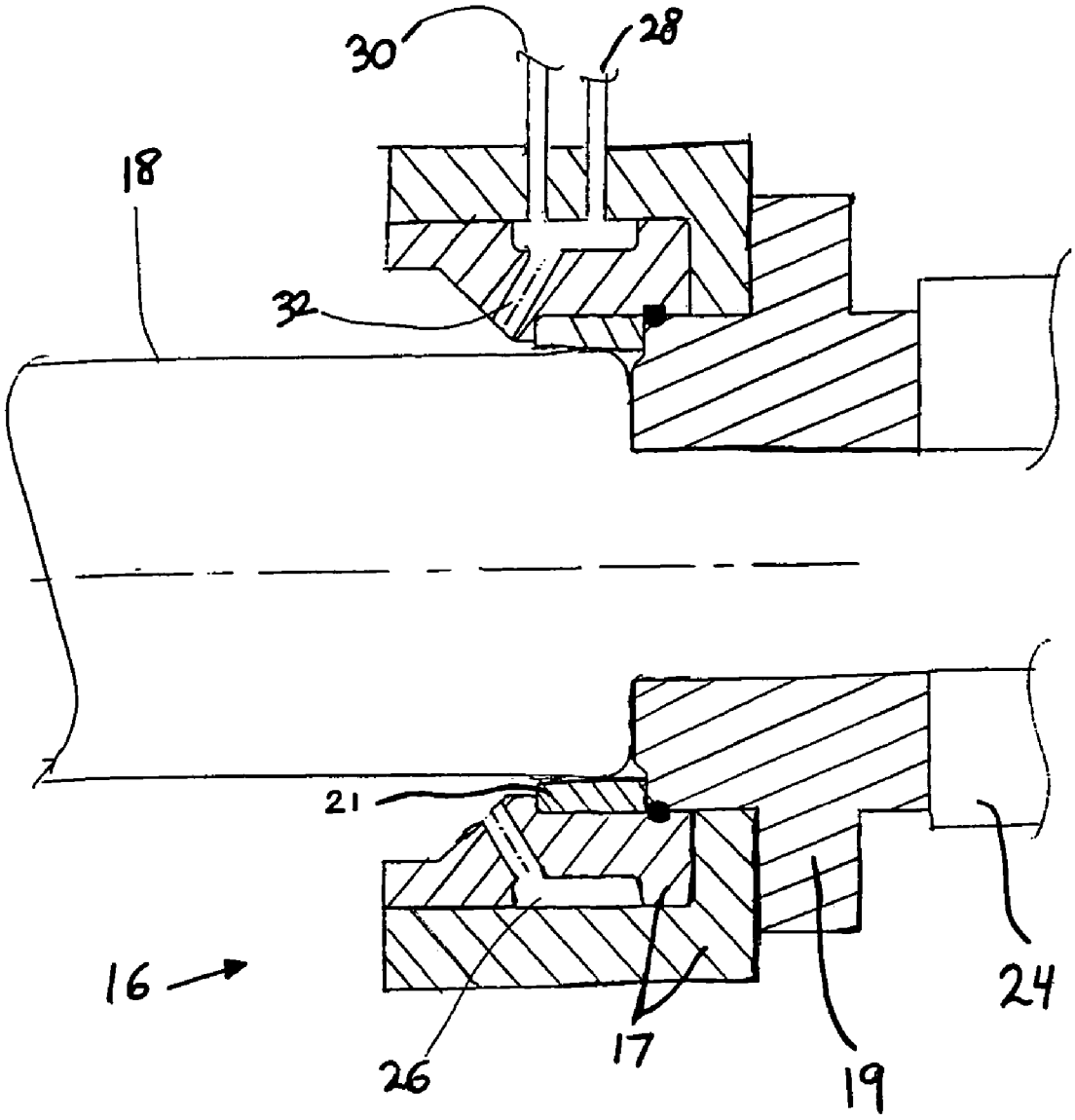
FIG. 5 is a cross-sectional view of the casting mould showing the emerging ingot during casting

As seen in FIG. 5, each casting mould 16 preferably includes a two piece mould body 17 machined from aluminum which includes an annular channel 26 within the mould body. A refractory entry channel 19 can also be included with the mould 16, and that mates at its inlet end with a downstream end of the drop-down trough section 24. The mould is further lined with a graphite member 21. The channel 26 is connected to a second coolant supply line 28 and includes at least one annular slot or a plurality of holes 32 running from the channel 26 to a surface of the casting mould 16 adjacent the emerging ingot 18. Coolant from the second coolant supply line 28 flows out through the slot or holes 32 to impinge against the skin formed on the emerging ingot 18, thereby cooling and solidifying the ingot 18. A gas supply line 30 is also connected to the channel 26 to supply gas for clearing the slot or holes 32 of coolant and preventing the entry of molten metal 12. Another embodiment of mould suitable for use is described in co-pending application Ser. No. 10/735,076 filed Dec. 11, 2003, published under Publication No. 2005-0126745 on Jun. 16, 2005. entitled "Horizontal Continuous Casting of Metals", assigned to the same assignee as the present invention, the disclosure of which is incorporated herein by reference.

Figure 6:
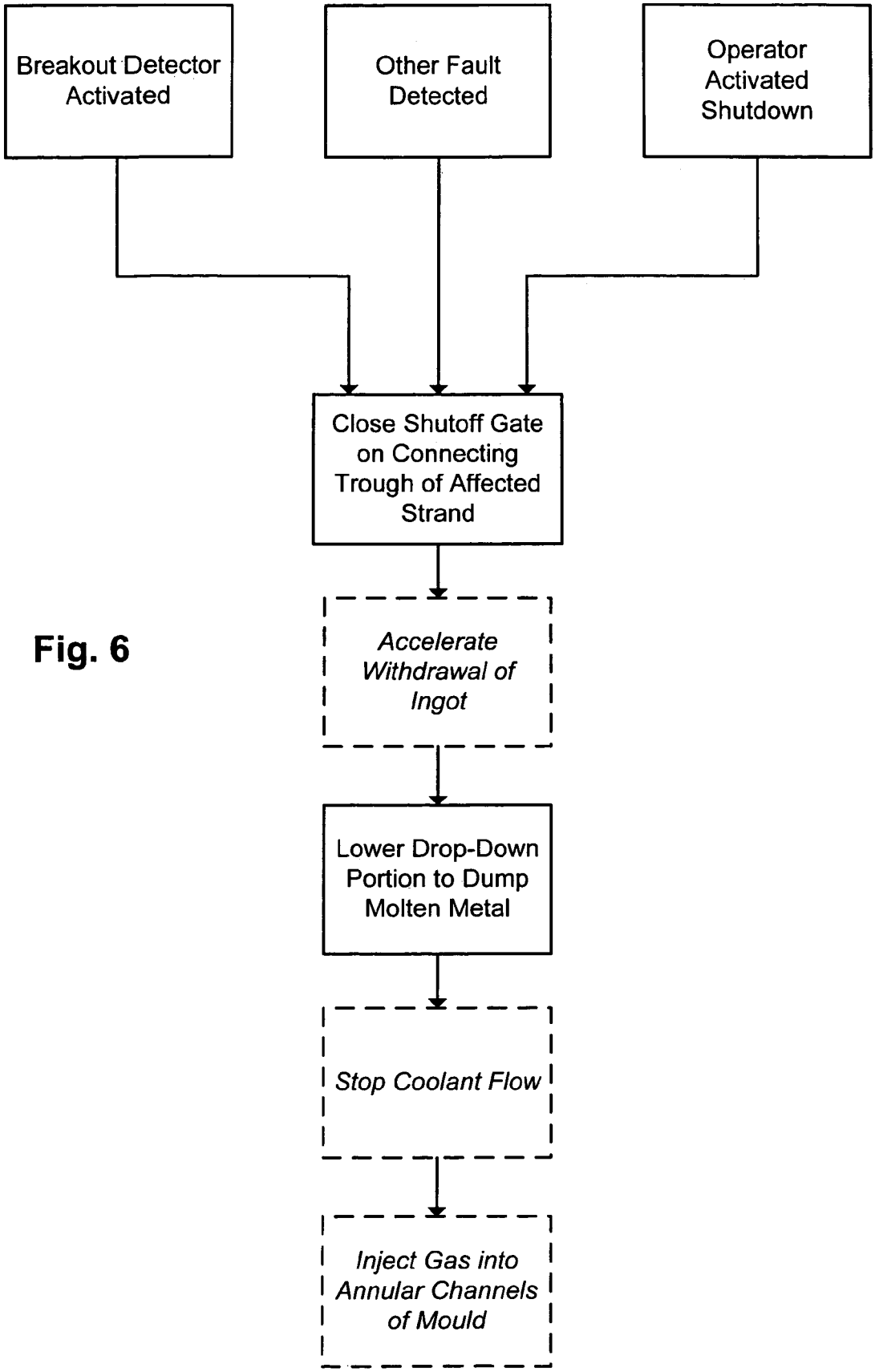
FIG. 6 is a flowchart of the steps for shutting down the horizontal continuous caster.

The flowchart of FIG. 6 illustrates some possible reasons for shutting down a particular strand of a multi-strand casting machine 10, and the subsequent steps that can be taken to isolate and shut down the strand. The breakout detector may be any sensor capable of identifying a liquid metal leak from the mould, but is preferably one as described in U.S. Pat. No. 6,446,704 (Collins) incorporated herein by reference. Other faults that may cause the sequence of events in the flowchart to occur include failure of a cutoff saw used to cut the continuously emerging ingot into sections or loss of synchronization between the ingot withdrawal mechanism and the ingot movement. The apparatus that may give rise to these types of shutdown events is described in co-pending application Ser. No. 10/735,077 filed Dec. 11, 2003, published under Publication No. 2005-0126741 on Jun. 16, 2005. entitled "Apparatus and Method for Horizontal Casting and Cutting of Metal Billets", assigned to the same assignee as the present invention, the disclosure of which is incorporated herein by reference.

In a first step, the particular strand is isolated from the feed trough 14 or from the reservoir, depending on the configuration, by closing the shutoff gate 22. The shutoff gate 22 is preferably biased closed and includes an actuator for holding the gate in an open position for normal operation. Suitable shutoff gates can include, for example normally closed gate valves. The next step is to lower the drop-down portion 24 to a downwards position so as to rapidly drain any molten metal 12 from the connecting trough 20 and the casting mould 16. The molten metal 12 can then be collected via channels 33 into dump bins 34, such as those illustrated in FIG. 1.

Between closing the shutoff gate 22 and lowering the drop-down portion 24, it is preferable to accelerate the rate of withdrawal of the ingot 18 by the conveying device 52 to clear the exit of the casting mould 16 and isolate the strand. After the drop-down portion is lowered, a further preferred step is to stop coolant flow from the coolant supply line 28 to the ingot 18. A final preferred step is to inject gas from the gas supply line 30 to the annular channel 26 and through the outlet holes 32 to clear these holes 32 of coolant and molten metal.

Figure 7:
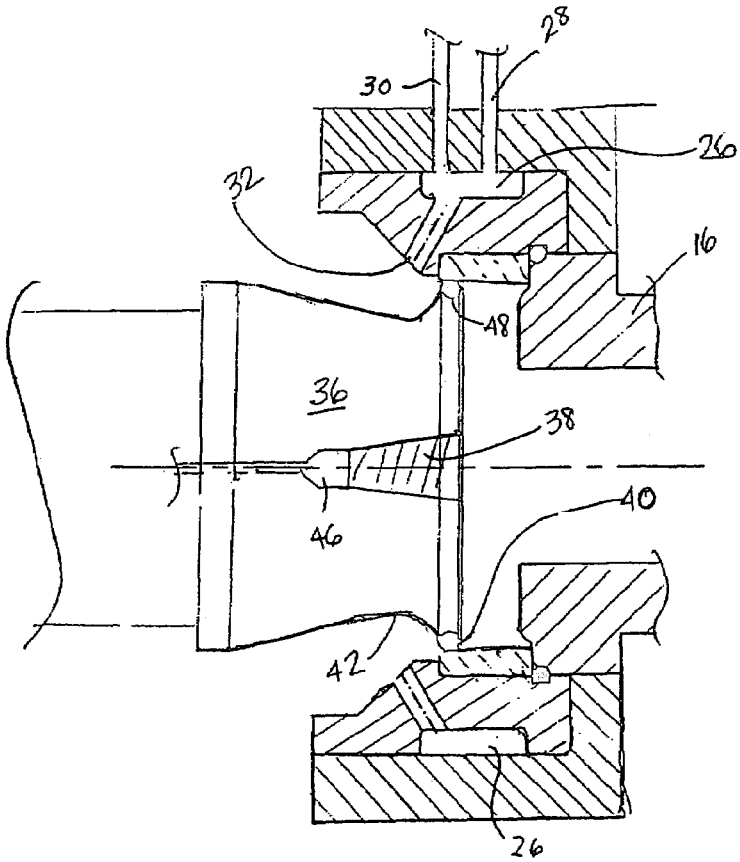
FIG. 7 is a cross-sectional view of the casting mould, holding the starter block of the present invention.
Figure 8:
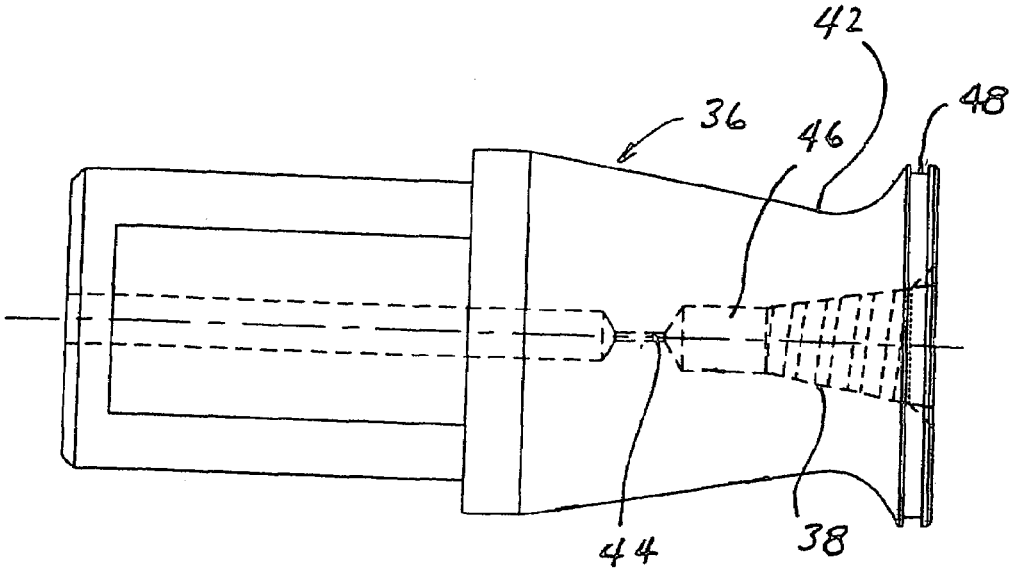
FIG. 8 is an elevation view of the starter block of the present invention.

FIGS. 7 and 8 show a starter block 36 for starting up or restarting a particular strand. The block 36 is generally elongated and sized at one end to be inserted in the mouth of the mould 16 and supported on the conveying device 52. A threaded, conical, recess 38 is formed in the block 36, parallel to the direction of flow of molten metal, for receiving molten metal. The starter block further comprises a circumferential groove 48 for receiving an O-ring 40. The O-ring 40 is adapted to engage the mouth of the casting mould 16 to positively seal the block 36 against the casting mould 16.

Preferably, the starter block 36 has a concave annular depression 42 adjacent the mould 16 adapted to deflect coolant away from the O-ring 40 thereby preventing contact between the coolant and the molten metal. The starter block 36 preferably further comprises an air vent 44, formed between the threaded recess 38 and a surface of the starter block 36, to allow venting of air from the recess 38 as it receives molten metal 12. More preferably, a porous plug 46 is provided in the recess 38 at the entrance to the air vent 44 that allows venting of air from the recess 38 while preventing molten metal from passing through the vent 44.

As the molten metal 12 passes through the casting mould 16 and cools to form a skin on the ingot 18, the starter block 36 disengages from the mouth of the mould 16 and exposes the ingot to the impinging coolant streams, thereby cooling and further solidifying the ingot 18. The starter block can then be unthreaded from the ingot for re-use.

What is claimed is:

1. An apparatus for continuous casting of metal ingots, comprising:

(a) a feed trough for carrying molten metal;

(b) at least one casting mould for casting metal ingots;

(c) a connecting trough separately connecting each said casting mould to the feed trough for transferring molten metal;

(d) a shutoff gate associated with each connecting trough and located adjacent the feed trough, said gate being movable between an open position and a closed position; and (e) each connecting trough including a drop-down portion located between the shutoff gate and the casting mould, said drop-down portion being adapted to swing downwardly and thereby rapidly drain molten metal from the connecting trough and an entrance of the mould.

2. The apparatus of claim 1 wherein the drop-down portion of the connecting trough is pivotably mounted on one end thereof.

3. The apparatus of claim 2 wherein the shut-off gate is biased closed and further comprises an actuator for holding the gate in an open position.

4. The apparatus of claim 1 further comprising:

(a) an annular channel formed in the casting mould having a coolant inlet to the channel and at least one opening for delivering coolant from the annular channel to a surface of the ingot during casting; and (b) a gas supply line connected to the annular channel for periodic injection of gas to clear the at least one opening of coolant or molten metal.

5. The apparatus of claim 1 wherein the feed trough is a heated trough.

6. The apparatus of claim 1 wherein the at least one connecting trough is a heated trough.

7. The apparatus of claim 1 further comprising a conveying device, positioned adjacent the mould and aligned in the direction of casting of the ingot, for conveying the ingot from the casting mould.

8. An apparatus for continuous casting of metal ingots, comprising:

(a) a trough for carrying molten metal;

(b) a casting mould for receiving molten metal, and casting the metal into metal ingots;

(c) a source of coolant positioned to impinge upon a surface of the ingot to cool said ingot;

(d) a conveying device aligned in the direction of casting of the ingot, for conveying the cast ingot from the casting mould;

(e) an elongated starter block, adapted to be inserted into the mould and supported by the conveying device and having a threaded recess formed therein for receiving molten metal; and (f) an O-ring fitted to the starter block for sealing the block against the casting mould.

9. The apparatus of claim 8 wherein the starter block has a concave annular depression on an outer face thereof adjacent the mould adapted to deflect coolant away from the O-ring.

10. The apparatus of claim 8 wherein the starter block further comprises an air vent, formed in the threaded recess and leading to an adjacent surface of the starter block, to allow venting of air from the recess as it receives molten metal.

11. The apparatus of claim 10 further comprising a porous plug placed in the threaded recess adjacent the air vent to hold molten metal in the recess while allowing venting of air from the recess.

12. An apparatus for continuous casting of metal ingots, comprising:

(a) a feed trough for conveying molten metal;

(b) at least one casting mould for casting metal ingots;

(c) a connecting trough separately connecting each said casting mould to the feed trough for transferring molten metal;

(d) a shutoff gate associated with each connecting trough and located adjacent the reservoir, said gate being movable between an open position and a closed position;

(e) each connecting trough including a drop-down portion located between the shutoff gate and the casing mould, said drop-down portion being adapted to swing downwardly and thereby rapidly drain molten metal from the connecting trough and an entrance of the mould;

(f) a conveying device associated with each casting mould aligned in the direction of casting of the ingot, for conveying the cast ingot from the casting mould;

(g) a elongated starter block, adapted to be inserted into the mould and supported by the conveying device and having a threaded recess formed therein for receiving molten metal; and (h) an O-ring fitted to the starter block for sealing the block against the casting mould.

13. A method of stopping casting of at least one strand in a multi-strand continuous molten metal caster for casting ingots, having a feed trough for carrying molten metal, at least one casting mould for casting metal ingots, a connecting trough separately connecting each said casting mould to the feed trough for transferring molten metal, a shutoff gate associated with each connecting trough and located adjacent the reservoir, said gate being movable between an open position and a closed position, each connecting trough, including a drop-down portion located between the shutoff gate and the casing mould, said drop-down portion being adapted to swing downwardly, the method comprising:

a. closing the shutoff gate to isolate said at least one strand from the feed trough; and b. swinging the drop down portion downwardly to rapidly drain molten metal from the connecting trough and an entrance of the mould.

14. The method of claim 13 further comprising, between closing the shutoff gate and swinging the drop down portion downwardly, accelerating the rate of extracting of the ingot from the mould.

15. The method of claim 13 wherein the casting mould is provided with an annular channel having a coolant inlet and at least one opening for delivering coolant to a surface of the ingot during casting, and an air supply line and air supply valve connected to the annular channel for clearing the at least one opening of coolant or molten metal, the method comprising shutting off the coolant inlet and injecting a gas from the air supply line through the at least one opening, to clear the opening, after swinging the drop-down portion downwardly.

* * * * *